US006045179A

United States Patent [19]

Harrison

[11] Patent Number: 6,045,179

[45] Date of Patent: Apr. 4, 2000

[54] PORTABLE AND ADJUSTABLE KEYBOARD STAND FOR COMPUTER

[76] Inventor: Paul A. Harrison, 1112 Legacy Oak Cir., Roswell, Ga. 30076

[21] Appl. No.: 08/893,168

[22] Filed: Jul. 15, 1997

[51] Int. Cl.[7] ..... A47C 7/62

[52] U.S. Cl. ..... 297/188.2; 297/188.21; 297/115; 297/411.24; 248/918; 248/447.1

[58] Field of Search ..... 297/186.01, 188.2, 297/115, 411.23, 411.24, 188.21; 248/918, 454, 447.1

[56] References Cited

U.S. PATENT DOCUMENTS

| | | | |
|---|---|---|---|
| Re. 15,296 | 2/1922 | Thompson | 297/188.01 |
| 3,899,164 | 8/1975 | Newman | 248/454 |
| 5,605,311 | 2/1997 | McGrath et al. | 248/918 |
| 5,709,365 | 1/1998 | Howard | 248/454 |

*Primary Examiner*—Peter M. Cuomo
*Assistant Examiner*—Anthony D. Barfield
*Attorney, Agent, or Firm*—William B. Noll

[57] ABSTRACT

A portable kit of components for mounting a computer accessory, such as a keyboard and operable mouse, to an armless chair. The accessory is removably attached to the chair, and readily transported between home and office, for example. The accessory comprises a saddle consisting of an essentially planar member adapted to rest on the seat of the chair, having a pair of downwardly extending side members, where each side member includes a tube receiving member for slidably receiving a second component. The side members include inwardly directed flanges having fastening positions for temporarily securing the saddle to the chair. Included in the kit of components are a pair of "T" shaped members (the second component) to be slidable received in and removably secured to the tube receiving member Finally, a pair of pivotal arms for removably engaging respective second arms of the "T" shaped member are provided. The remote ends include stands for mounting the computer accessory.

12 Claims, 3 Drawing Sheets

PORTABLE AND ADJUSTABLE KEYBOARD STAND FOR COMPUTER

FIELD OF INVENTION

This invention relates to a portable and adjustable keyboard stand for the operation of a computer. Computers for the home and business are now the norm for most Americans, where work demands, such as on professionals, may require work to be taken home to be finished. Extended time at a fixed or stationary computer workstation can often result in "joint" problems, i.e. to the wrist or elbow, that can make continuance thereat difficult and painful. The present invention offers relief in that area by the provision of a portable and adjustable keyboard stand, that can be easily transported and secured to most standard armless chairs at home or in the office.

BACKGROUND OF THE INVENTION

Most computer desks offer a keyboard stand that pulls out horizontally to the operator for use, then pushed back or recessed for storage or non-use. Where a "mouse" is used, it typically rests on the desk top elevated above the keyboard, see U.S. Pat. Nos. 5,474,373 and 5,364,177. For long term use, these positions can cause discomfort in the hands or arms.

The above patents, as well as related patents, are directed to the more conventional fixed workstations which may offer many conveniences the operators, but not in the adjustability of the keyboard position and mouse operation. However, U.S. Pat. No. 5,022,706, seems to move in the right direction by offering an adjustable keyboard chair. At least it recognizes that user comfort is important. The patent describes a caster-movable chair having a keyboard support table hingedly attached to the front of each side arm of the chair, and pivotable about each of two orthogonal axes. The support tables are foldable from a generally horizontal position disposed above the chair seat and in front of the chair side arms and the user, to a stored position disposed adjacent the outside sides of the chair and side arms when the support tables are not in use. One option this gives to the user is the ability to move away from the computer monitor.

An earlier patent also addresses comfort for the user. U.S. Pat. No. 4,046,419 discloses a rail-mounted chair with adjustment means to accommodate an individual user's position and attitude in front of a desk or worktable. The patent further discloses moveable armrests with a detachable flat worktable which can be positioned in front of the user. Finally, there is taught the use of a rail and roller means to provide ease of adjustment of distance from the workstation. However, this same rail means severely limits the extent of movement available to the operator.

None of these patents, nor others reviewed, offer the comfort and utilitarian features of the present invention. The manner by which such features are realized will become apparent from the following specification, particularly when read in conjunction with the attached drawings.

SUMMARY OF THE INVENTION

This invention relates to a computer accessory for mounting a computer keyboard and operable mouse, where the accessory is removably attached to a conventional armless chair. The accessory is formed of light-weight components and may be transported unassembled, from home to office, for example, then readily reassembled as desired. The accessory comprises a saddle consisting of an essentially planar member adapted to rest on the seat cushion of the chair, a pair of downwardly extending side members, where each side member includes an inwardly directed flange having means thereon for temporarily securing the saddle to the chair. The accessory further includes a pair of "T" shaped members removably secured to a respective side member, and a pivotal arm removably engaged with a second arm of each "T" shaped member. The remote end of each pivotal arm includes means for mounting a computer accessory, such as a keyboard or mouse.

DETAILED DESCRIPTION OF PREFERRED EMBODIMENT

This invention relates to a kit of transportable components that may be readily assembled into a computer accessory. More specifically, the invention is directed to adjustable keyboard and mouse stands, where the accessory may be secured to most standard armless chairs at home or in the office.

Figure 1:
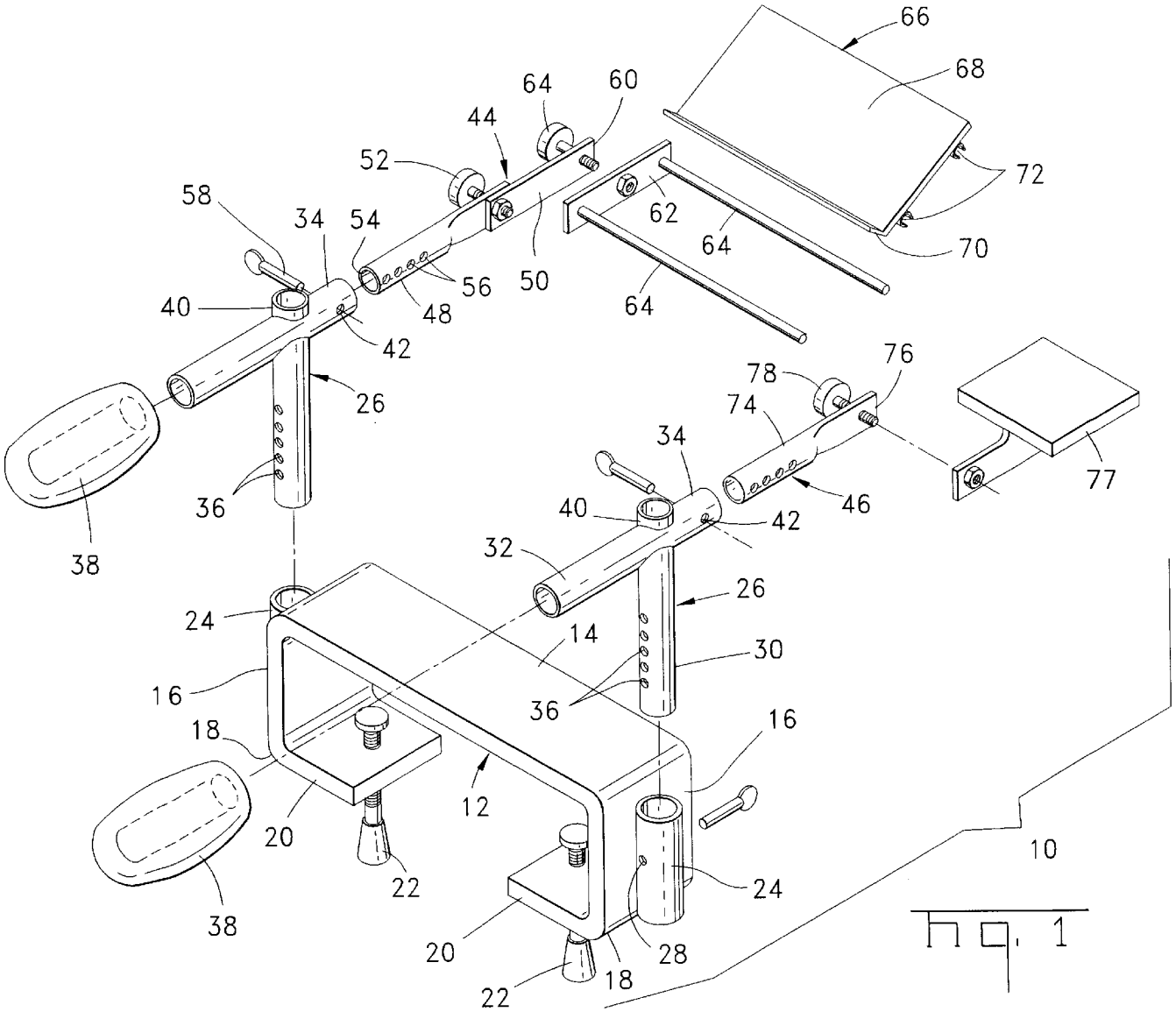
FIG. 1 is an exploded perspective view of the computer accessory according to this invention, showing the various components thereof, without a chair upon which the accessory is to be removably attached.
Figure 2:
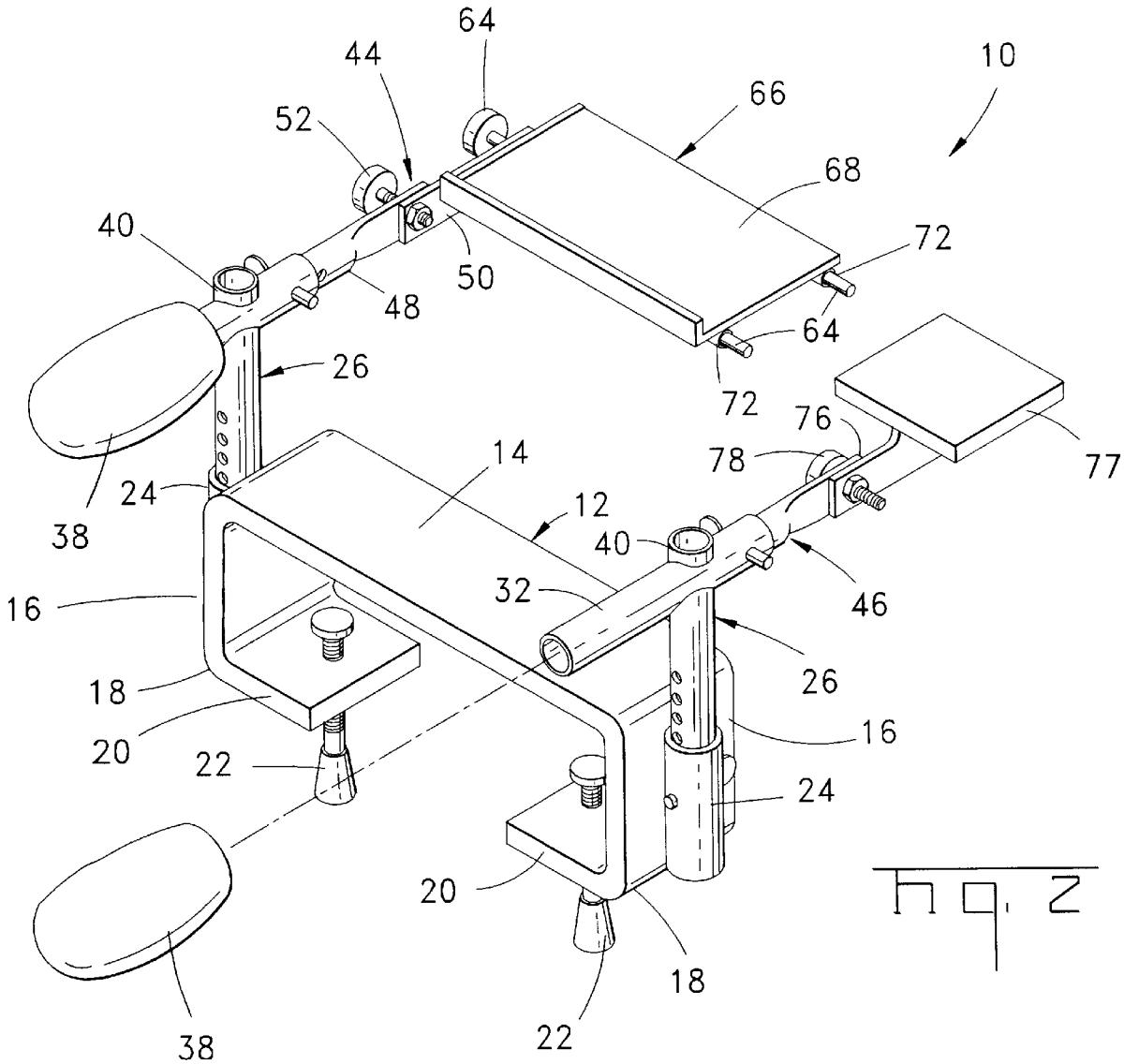
FIG. 2 is a perspective view of the assembled computer accessory of FIG. 1.

FIGS. 1 and 2 illustrate the various components forming the computer accessory 10 according to this invention, first in an exploded or isolated position, then in the assembled position. The base, to which the remaining components are directly or indirectly secured, is the saddle 12, which may be injection molded of plastic, or assembled of plural parts of other light-weight materials. The saddle 12 preferable comprises an essentially planar member or upper portion 14 to rest on a seat cushion, not shown, a pair of downwardly extending side members 16. Extending inwardly from the ends 18, opposing flanges 20 are provided. The function of the respective flanges 20 is to underlie the seat cushion, and to position a pair of clamping mechanisms 22 for contacting the underside of the seat cushion and securing same thereabout. Since the user or operator will sit on the planar member, for comfort it may be padded. Though not preferred, the saddle may comprise a pair of "C" shaped members that grip the opposite edges of the set cushion. That is, such pair are independent and not connected to one another. This arrangement may be preferred for a non-cushioned chair, for example. In any case, a cushion or pad may be desirable to override the saddle for user comfort.

Secured to the respective side members 16 are a pair of tubular rod receiving fixtures 24 for receiving "T" shaped supports 26, as defined hereafter. In a preferred embodiment, the fixture 24 includes a pair of aligned through holes 28, which cooperate with a known type fastener, i.e. bolt and nut, for example, to secure a respective "T" shaped support 26.

The "T" shaped support 26 includes a verticle support leg 30, and a pair of aligned legs 32, 34, essentially perpendicular thereto. The support leg 30, configured to be slidably received within the fixture 24, may be provided with a plurality of through holes 36. By this arrangement, the "T"

shaped support 26 can be vertically adjusted to accommodate the user. That is, the "T" shaped support 26 may be inserted into the fixture 24 to its desired height, then secured therein by a fastener being inserted through the aligned holes 28, 36.

One aligned leg 32, projecting rearwardly or away from the intended workstation, is primarily for user comfort. Specifically, the leg 32 may be provided with an arm rest pad 38, which may for convenience by a cylindrical pad slidably received on the leg 32. If desirable, a stop 40 for the arm rest pad 38 may be provided.

The second aligned arm 34 is provided with a single through hole 42 to secure a pivotal arm 44, 46, as hereinafter explained. The respective pivotal arms 44, 46 are configured to be telescopically received within aligned arm 34.

Figure 3:
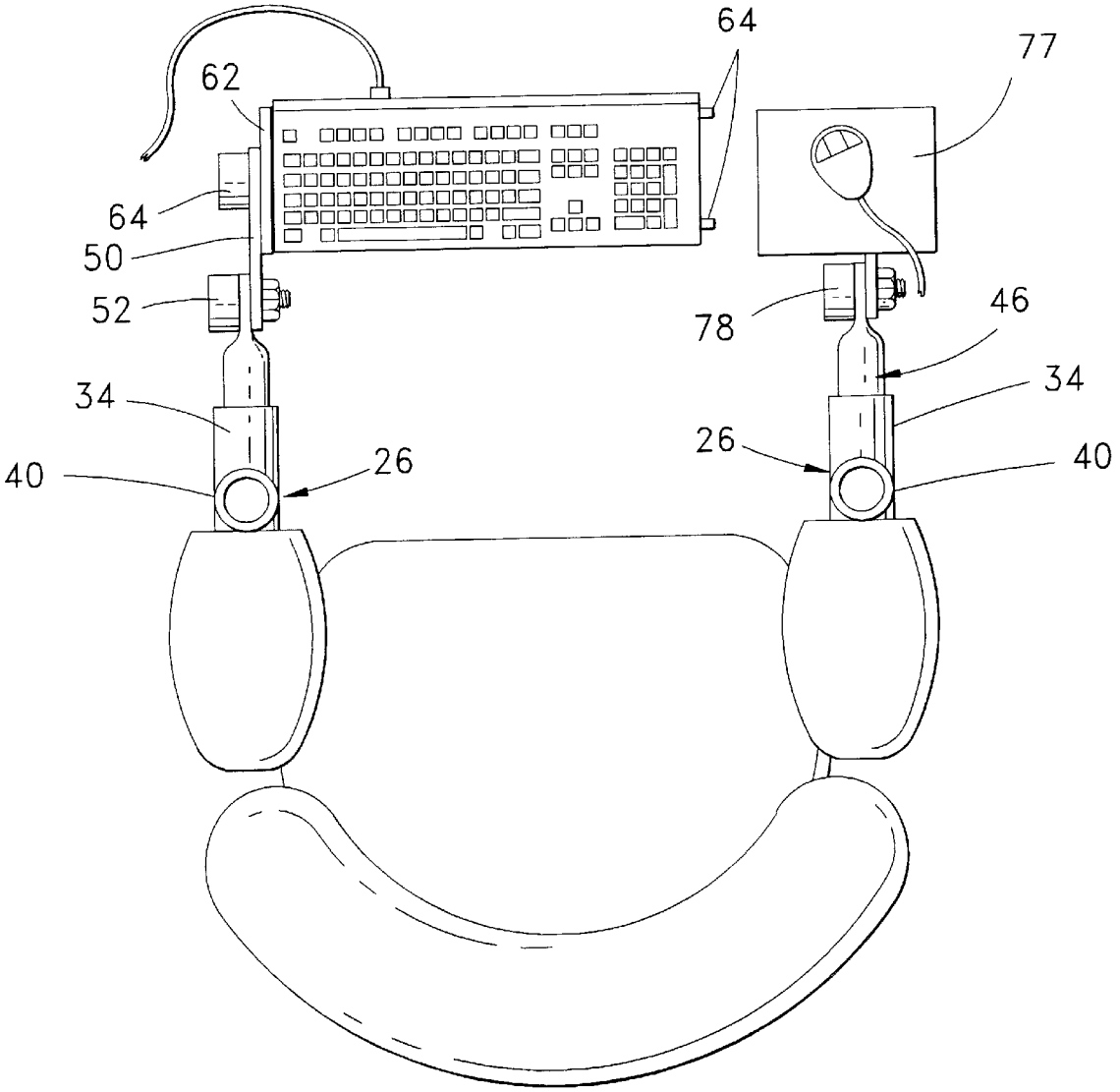
FIG. 3 is a top or plan view of the assembled computer accessory of FIG. 2, illustrating in addition its relationship to the chair upon which it is mounted, and an exemplary keyboard and mouse.

The respective pivotal arms 44, 46 are the key support components for the keyboard and mouse stand, see FIG. 3. For ease of understanding, the pivotal arm 44 may also be designated the keyboard pivotal arm, while pivotal arm 46 may be termed the mouse pivotal arm. While FIG. 3 shows the arrangement for such arms to accommodate a right-handed user, it should be understood that the respective arms 44, 46 may shifted to the other side should the user prefer a left-handed operated mouse. In any case, the keyboard pivotal arm 44 comprises a pair of planarly arranged arm segments 48, 50 pivotally joined by a locking clamp 52 at their ends, where the free end 54 of arm segment 48 is intended to telescopically engage aligned arm 34. To accommodate adjustments for the user, a plurality of through holes 56 may be provided. To set the arm segment 48 into position, it is pushed to the desired depth within arm 34 and secured thereto by a fastener 58, as known in the art.

The free end 60 of arm segment 50 includes pivotal rocker member 62, from which a pair or parallely arranged rods 64 project. The rocker member 62 is capable of a 360 degree rotation, until locked into position by the rotary clamp 64. This is significant when one realizes the various positions in which one may place the accessory.

The keyboard stand 66 is designed to snap-on to the rods 64. The keyboard stand consists of a planar panel member 68 with an optional rim 70 on the upper surface against which the keyboard rests. The underside of panel member 68 may include a pair of spaced-apart channels 72 which are designed to snap-fit onto the equally spaced-apart rods 64, thereby providing a working stand for the keyboard. By the use of the dual pivot locks 52, 64, one can raise, lower, or tilt the keyboard as desired, or even reset to a different position to relieve strain on one's joints.

The pivotal arm 46, for the mouse, for example, is composed of a single leg segment 74, similarly designed to telescopically engage with the "T" shaped support 26 as with the keyboard pivotal arm 44. The free end 76 may include a comparable rocker arm arrangement as found with keyboard pivotal arm 44, or a rotatable plate 77 that can be set and locked by rotary clamp 78. When using the mouse, the plate 77 is a suitable resting surface for the mouse pad, as known in the art. Alternately, if a mouse is not being used, the plate may be rotated, angled, and fixed to receive a document that needs review by the user during operation of the computer.

ASSEMBLY DIRECTIONS (1) Place the saddle 12 over an existing armless chair and tighten the clamping mechanism 22 underneath the bottom of the chair, (2) Slide the "T" shaped supports 26 into a respective rod receiving fixture 24 and secure same at the desired height, (3) Slide the pivotal arms 44, 46, into one of the support legs 34, and fasten same, and (4) Snap-on the Keyboard stand 66 and adjust as desired. If the mouse plate 77 is similarly designed, it too should be snapped-on, otherwise it should be ready to use.

I claim:

1. A user friendly computer accessory for mounting a computer keyboard and operable mouse, where said accessory is to be removably attached to a conventional armless chair, said accessory comprising (a) a saddle consisting of an essentially planar member adapted to rest on the seat cushion of said chair, a pair of downwardly extending side members, where each said side member includes an inwardly directed flange having means thereon for temporarily securing said saddle to said chair, (b) a pair of "T" shaped members, having an arm of each said member removably secured to a respective said side member, and (c) a pair of pivotal arms each having a remote end and removably engaged with a second arm of a respective said "T" shaped member, where said remote end of each said pivotal arm includes means for mounting a computer related accessory, where said related accessory is selected from the group consisting of a keyboard and an operable mouse.

2. The user friendly computer accessory according to claim 1, wherein one of said pivotal arms includes two members pivotally secured to one another.

3. The user friendly computer accessory according to claim 2, wherein said means for mounting one of said computer accessories includes a rocker arm having a pair of parallel arms extending normal to said rocker arm.

4. The user friendly computer accessory according to claim 3, including a planar member mounted on said parallel arms for receiving said keyboard.

5. The user friendly computer accessory according to claim 1, wherein each said pivotal arm telescopically engages a respective said second arm of a said "T" shaped member.

6. The user friendly computer accessory according to claim 1, wherein a third arm of each said "T" shaped member, aligned with a said second arm, includes a padded arm rest.

7. A computer accessory consisting of a portable and adjustable keyboard stand, adapted to be removably attached to a conventional armless chair, said accessory comprising (a) a saddle consisting of an essentially planar member adapted to rest on the seat cushion of said chair, a pair of downwardly extending side members, where each said side member includes an inwardly directed flange having means thereon for removably attaching the saddle to said chair, (b) a pair of "T" shaped support members having a first leg removably secured to a respective said side member, and (c) a pair of pivotal arms each having a remote end and removably engaged with a second arm of a respective said "T" shaped support member, where said remote end of each said pivotal arm includes means for mounting a computer related accessory, where said related accessory is selected from the group consisting of a keyboard and an operable mouse.

8. The computer accessory according to claim 7, wherein one said remote end includes a pivotal rocker arm having a pair of parallelly arranged rods extending normal thereto, and a planar support secured to said rods, for receiving a computer keyboard.

9. The computer accessory according to claim 8, wherein said rocker arm of said pivotal arm includes an intermediate pivot to allow vertical adjustment of said planar support.

10. The computer accessory according to claim 8, wherein each said "T" shaped support member includes a third arm, aligned with said second arm, which is padded to provide support to the computer operator.

11. The computer accessory according to claim 8, wherein the other said remote end includes means for mounting a planar plate for conveniently operating a computer mouse.

12. A kit of light-weight components for assembling a computer accessory, where said accessory is adapted to be secured to an armless chair for positioning a computer keyboard and operable mouse, said kit including (a) a saddle consisting of an essentially planar member adapted to rest on the seat cushion of said chair, a pair of downwardly extending side members, where each said side member includes an inwardly directed flange having means thereon for removably attaching the saddle to said chair, (b) a pair of "T" shaped support members having a first leg to be removably secured to a respective said side member, and (c) a pair of pivotal arms each having a remote end and intended to be removably engaged with a second arm of a respective said "T" shaped support member, where said remote end of each said pivotal arm includes means for mounting a keyboard or operable mouse.

* * * * *